US008534938B2

(12) United States Patent
Iga

(10) Patent No.: US 8,534,938 B2
(45) Date of Patent: Sep. 17, 2013

(54) PRINTER AND METHOD FOR SWITCHING BETWEEN STANDARD MODE AND LINER-LESS MODE

(75) Inventor: Kaname Iga, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 352 days.

(21) Appl. No.: 12/878,597

(22) Filed: Sep. 9, 2010

(65) Prior Publication Data

US 2011/0200377 A1 Aug. 18, 2011

(30) Foreign Application Priority Data

Feb. 18, 2010 (JP) ..... 2010-34017

(51) Int. Cl.

| | |
|---|---|
| ***B41J 29/38*** | (2006.01) |
| ***B41J 11/42*** | (2006.01) |
| ***B41J 15/00*** | (2006.01) |
| ***B41J 3/36*** | (2006.01) |

(52) U.S. Cl.
USPC ..... 400/76; 400/611; 400/613

(58) Field of Classification Search
USPC ..... 400/76, 611, 613; 347/218
See application file for complete search history.

(56) References Cited

U.S. PATENT DOCUMENTS

| | | | | |
|---|---|---|---|---|
| 6,412,900 | B2 * | 7/2002 | Horigome | 347/19 |
| 7,271,819 | B2 * | 9/2007 | Matsutani et al. | 347/196 |
| 2006/0132580 | A1 * | 6/2006 | Mindler | 347/171 |
| 2009/0290925 | A1 * | 11/2009 | Huggins et al. | 400/613 |
| 2010/0002065 | A1 * | 1/2010 | Koyabu | 347/215 |

FOREIGN PATENT DOCUMENTS

| | | | |
|---|---|---|---|
| JP | 2000-052612 | | 2/2000 |
| JP | 2000094732 A | * | 4/2000 |
| JP | 2004-314425 | | 11/2004 |
| JP | 2007-223164 | | 9/2007 |

* cited by examiner

*Primary Examiner* — Daniel J Colilla
(74) *Attorney, Agent, or Firm* — Turocy & Watson, LLP

(57) ABSTRACT

According to one embodiment, a printer includes a motor and a roller turned by the motor to discharge a backing sheet-attached label from a roll wound with the backing sheet-attached label, or a liner-less label from a roll wound with the liner-less label with an adhesive surface on one side of the liner-less label. The printer further includes a print unit to perform printing on the backing sheet-attached label or the liner-less label discharged from the roll, a switching unit to switch the printer to a standard mode in which the print unit performs printing on the backing sheet-attached label or a liner-less mode in which the print unit performs printing on the liner-less label, and a control unit to control the operation of the motor in response to the switching of the printer to the standard mode or the liner-less mode.

14 Claims, 8 Drawing Sheets

PRINTER AND METHOD FOR SWITCHING BETWEEN STANDARD MODE AND LINER-LESS MODE

CROSS-REFERENCE TO RELATED APPLICATIONS

This application is based upon and claims the benefit of priority from Japanese Patent Application No, 2010-034017, filed on Feb. 18, 2010, the entire contents of which are incorporated herein by reference.

FIELD

Embodiments described herein relate generally to a printer for printing a backing sheet-attached label or a liner-less label and a printing method.

BACKGROUND

In general, a printer for use in printing a backing sheet-attached label and a liner-less label prints at a constant printing speed either when printing a backing sheet-attached label discharged from a roll of backing sheet-attached labels with an interlaid backing sheet or when printing a liner-less label discharged from a roll of liner-less labels with an interlaid adhesive surface.

In the roll of liner-less labels, the liner-less labels are wound in a roll shape with an adhesive surface on one side of the liner-less label. Therefore, as compared with the roll of backing sheet-attached labels in which the backing sheet-attached labels are wound in a roll shape with a backing sheet having no adhesiveness, more force is required in stripping the liner-less label from the roll of liner-less labels.

As described above, the printer of related art performs printing at a constant printing speed either when printing the backing sheet-attached label discharged from the roll of backing sheet-attached labels or when printing the liner-less labels discharged from the roll of liner-less labels. In this case, a problem is posed in that a motor load required for driving a roller grows higher when discharging the liner-less label from the roll of liner-less labels. Particularly, in a portable printer with a motor driven by electric power supplied from a battery, battery consumption becomes greater if the motor load grows higher. Thus, the portable printer cannot be used for a long period of time.

DETAILED DESCRIPTION

According to one embodiment, a printer includes a motor and a roller turned by the motor to discharge a backing sheet-attached label from a roll wound with the backing sheet-attached label, or discharge a liner-less label from a roll wound with the liner-less label with an adhesive surface on one side of the liner-less label. The printer further includes a print unit to perform printing on the backing sheet-attached label or the liner-less label discharged from the roll, and a switching unit to switch the printer to any one of a standard mode in which the print unit performs printing on the backing sheet-attached label and a liner-less mode in which the print unit performs printing on the liner-less label. Further, the printer includes a control unit to control the operation of the motor in response to the switching of the printer to any one of the standard mode and the liner-less mode.

Certain embodiments of a printer, a printing method and a recording medium having a printing program will now be described in detail with reference to the accompanying drawings. In one embodiment, description will be made with respect to an example in which the printer, the printing method and the printing program are applied to a portable thermal printer that contains a roll of backing sheet-attached labels or a roll of liner-less labels and performs printing by heating the print surface of a backing sheet-attached label or a liner-less label with a thermal head.

Figure 1:
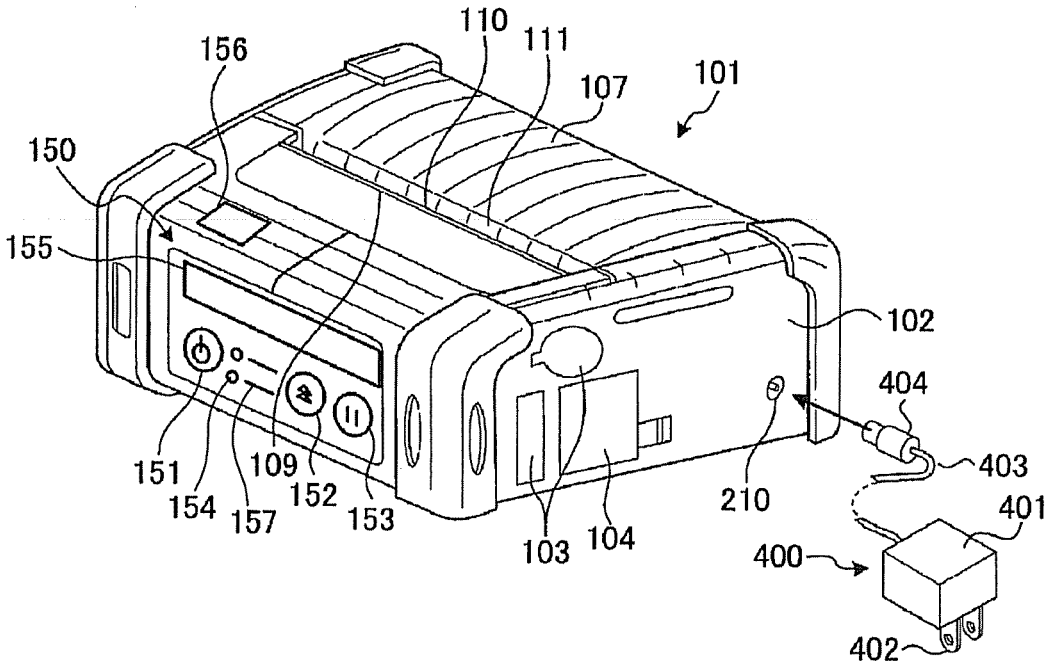
FIG. 1 is a perspective view of a portable printer according to one embodiment.
Figure 2:
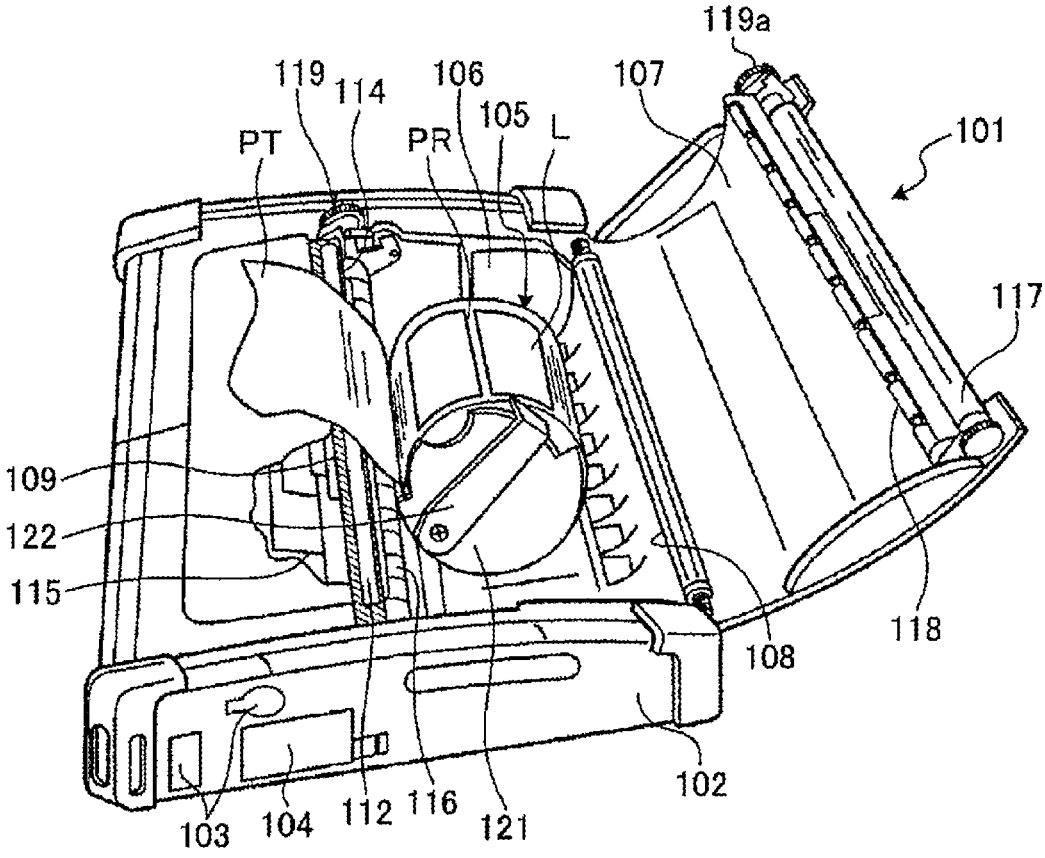
FIG. 2 is a perspective view of the portable printer whose cover is open.
Figure 3:
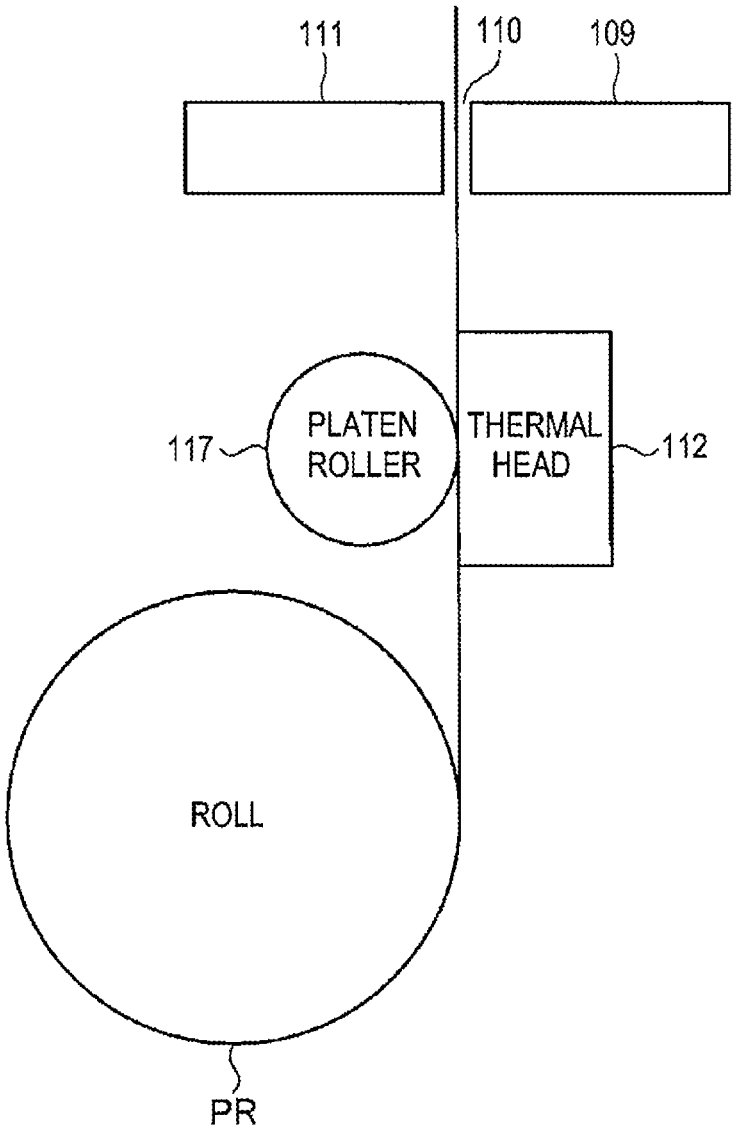
FIG. 3 is a schematic diagram illustrating a label conveying path.

The schematic structure of a portable printer 101 will be described with reference to FIGS. 1 to 3. FIG. 1 is a perspective view of the portable printer 101. FIG. 2 is a perspective view of the portable printer 101 whose cover is open. FIG. 3 is a schematic diagram illustrating a label conveying path.

The portable printer 101 has a rectangular parallelepiped shape. The portable printer 101 includes a print mechanism 300 (see FIG. 4) to carry out a printing function and a paper feeding function, a rechargeable battery 270 (see FIG. 4) used as a power source and a housing 102 to accommodate the print mechanism 300 and the rechargeable battery 270 therein. In the present embodiment, a lithium-ion battery may be used as the rechargeable battery 270. The housing 102 has an internal structure to store a paper roll PR wound with a backing sheet-attached label having a label adhesively bonded to a backing sheet or a paper roll PR wound with a liner-less label having an adhesive surface, e.g., a glue surface. An opening 106 is defined on the upper surface of the housing 102 so that the paper roll PR can be put in the housing 102 through the opening 106. A cover 107 is pivotally arranged in the opening 106. The cover 107 may open or close, which makes the opening 106 in an open state or a close state.

Further, the housing 102 includes a cover opening-closing sensor 50 (see FIG. 4) for detecting the open state and the close state of the cover 107. The cover opening-closing sensor 50 may include a micro-switch, which may in some embodiments be a mechanical sensor. When the cover 107 is opened from the housing 102 to make the opening 106 open, the cover opening-closing sensor 50 comes into an off-state in which no electric current flow. On the other hand, if the cover 107 covers the opening 106, the cover opening-closing sensor 50 comes into an on-state in which an electric current flows. The cover opening-closing sensor 50 is not limited to the above-mentioned micro-switch, but may include a contactless switch provided with a photo sensor or other switches.

The cover 107 is attached to an inner side 108 of the housing 102 defining one side of the opening 106. When the cover 107 is in a closed state, a slot for discharging a printed backing sheet-attached label or a printed liner-less label is formed between the outer side 111, i.e., the front end of the cover 107 and the front side 109, i.e., one side of the opening 106. This slot extends in the transverse direction of the portable printer 101 and serves as a paper outlet 110.

On one lateral surface of the housing 102, there are arranged a connector portion 103 including a variety of connectors and a battery storage portion 104 to detachably enclose the rechargeable battery 270.

The front side 109 of the housing 102 or the outer side 111 of the cover 107, respectively defining the paper outlet 110, has a sharp-edged shape to cut the backing sheet-attached label or the liner-less label discharged from the paper outlet 110.

The housing 102 includes a paper storage portion 105 to detachably enclose the paper roll PR. The paper roll PR is enclosed in the paper storage portion 105 with a roll shaft oriented in the transverse direction of the portable printer 101. The platen roller 117 is turned by the stepping motor 131 (see FIG. 4) used as a drive power source, thereby discharging the backing sheet-attached label or the liner-less label from the paper roll PR stored in the paper storage portion 105 and conveying the discharged label toward the paper outlet 110 (see FIG. 1). The platen roller 117 is arranged to be opposed to the thermal head 112, which will be described below. The platen roller 117 can be turned by the stepping motor 131 (see FIG. 4) used as a drive power source in the direction opposite to the direction in which the backing sheet-attached label or the liner-less label is discharged from the paper roll PR, thereby back-feeding the backing sheet-attached label or the liner-less label that has already reached the paper outlet 110.

The thermal head 112 is detachably mounted to a head bracket 115, which is arranged in the lower portion. The head bracket 115 is fixed to the housing 102 to abut against the thermal head 112 in the upper inner direction of the portable printer 101. A head cover 116 is arranged near the thermal head 112 at the inner side of the portable printer 101 from the thermal head 112. The head cover 116 is selectively mounted to the housing 102, thereby abutting against the thermal head 112 to prevent the thermal head 112 from vibrating.

The thermal head 112 includes a plurality of heating elements 114 arranged in a row with a certain density. As the heating elements 114 generate heat under the control of a head control unit 133 (see FIG. 4), the thermal head 112 performs printing by heating the print surface of the backing sheet-attached label or the liner-less label. The thermal head 112 is detachably mounted to the head bracket 115. The thermal head 112 with e.g., 200 dpi or 300 dpi, may be selectively mounted to the head bracket 115.

As shown in FIG. 3, the paper outlet 110 is arranged at the downstream side of the thermal head 112 along the discharging direction of the backing sheet-attached label or the liner-less label.

A driving gear 119 is arranged within the housing 102. The driving gear 119 is turned by a stepping motor 131 (see FIG. 4) used as a drive power source, which is operated under the control of a motor control unit 134 (see FIG. 4).

A paper pressing roller 118 is arranged near the platen roller 117 in the cover 107. The platen roller 117 and the paper pressing roller 118 are rotatable along their rotation axes extending in the transverse direction of the portable printer 101.

The platen roller 117 is arranged at a position in the cover 107, where it can make contact with the heating elements 114 of the thermal head 112 when the cover 107 is in the closed state. The platen roller 117 is coupled with a driven gear **119*a* on the left side of the platen roller 117, when viewed from the front side of the printer 101**, so as to rotate together.

The driven gear **119*a* is engaged with the driving gear 119 so as to be driven by the driving gear 119, when the cover 107 comes into the closed state. The paper pressing roller 118 is coupled to the cover 107 at such a position that it can make contact with the head cover 116 when the cover 107 is in the closed state. When the cover 107 is closed, the driven gear 119*a* mounted to the cover 107 is engaged with the driving gear 119, thus rotationally driving the platen roller 117 coupled to the driven gear 119*a*. In the present embodiment, the driving gear 119 and the driven gear 119*a* serve as a transmission 132 (see FIG. 4**).

In the present embodiment, the paper roll PR is arranged within the paper storage portion 105 in such a fashion that it can be attached or detached by a lever 122. The paper roll PR is positioned between two guide fences 121. The space between two guide fences 121 can be adjusted in accordance with the width of the paper roll PR.

The housing 102 includes a direct current (DC) power input part 210 for inputting DC power from an external power source. A plug 404 of an AC adapter 400 is inserted into the DC power input part 210, so that DC power is supplied to the portable printer 101.

The AC adapter 400 is provided separately from the portable printer 101. The AC adapter 400 is inserted into an external commercial power socket to output DC power from the plug 404. The AC adapter 400 includes a main body 401 provided with a DC conversion circuit, a socket plug 402 attached to the main body 401, a cable 403 to output DC power, and a cable plug 404. The AC adaptor 400 converts the electric power of, e.g., AC 100V, inputted from the socket plug 402 to the electric power of e.g., DC 20V, which is then outputted to the cable plug 404 provided at the tip end of the cable 403.

Besides a general-purpose AC adapter, a car adapter (with input power and output power of 12V), a DC-DC converter (with input power of 10V to 60V and output power of 20V) may be used as the device for supplying DC power to the DC power input part 210. If the cable plug 404 is connected to the DC power input part 210, DC power is supplied to the portable printer 101. This brings the rechargeable battery 270 into a rechargeable state.

In the housing 102, there is also provided an operation part 150. The operation part 150 includes a power switch 151, a paper feeding button 152 for allowing a user to instruct paper feeding, and a pause button 153 for allowing a user to instruct temporary stoppage of the paper feeding. The operation part 150 further includes an indicator 154 to notify the user of the charge state of the rechargeable battery 270, a liquid crystal display (LCD) 155, and a communication window 156. The operation part 150 further includes a switching unit 157 enabling a user to perform a switching operation to a standard mode to print on a backing sheet-attached label or a liner-less mode to print on a liner-less label. In general, the portable printer 101 may perform data transmission and reception by, e.g., infrared communication through the communication window 156 and the communication interface 140 (see FIG. 5). For example, the portable printer 101 may receive and store print data in a RAM (random access memory) 13 or a flash memory 14 (see FIG. 5).

Figure 4:
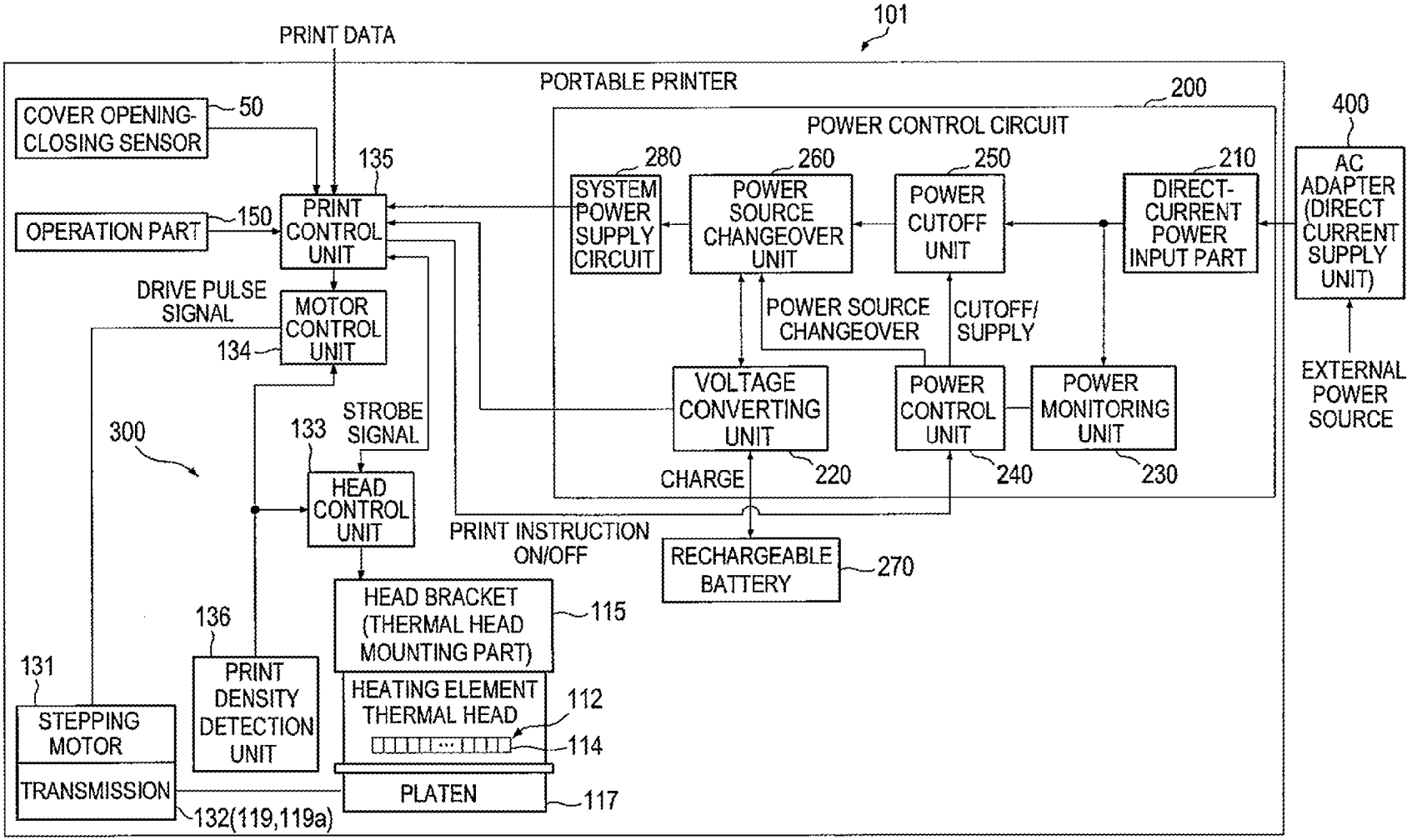
FIG. 4 is a block diagram of a control system of the portable printer.

In the following, the control system of the portable printer 101 will be described. FIG. 4 is a block diagram of a control system of the portable printer 101.

As shown in FIG. 4, the print mechanism 300 of the portable printer 101 includes a head control unit 133 to output print control signals including a strobe signal and a print signal to the thermal head 112 and a motor control unit 134 to output a drive pulse signal to the stepping motor 131. The print control unit 135 controls all components of the printer, including the cover opening-closing sensor 50, the operation part 150 and the print mechanism 300.

The print mechanism 300 of the portable printer 101 includes a print density detection unit 136 to detect whether the thermal head 112 mounted to the head bracket 115 has a print density of 200 dpi or 300 dpi.

Figure 5:
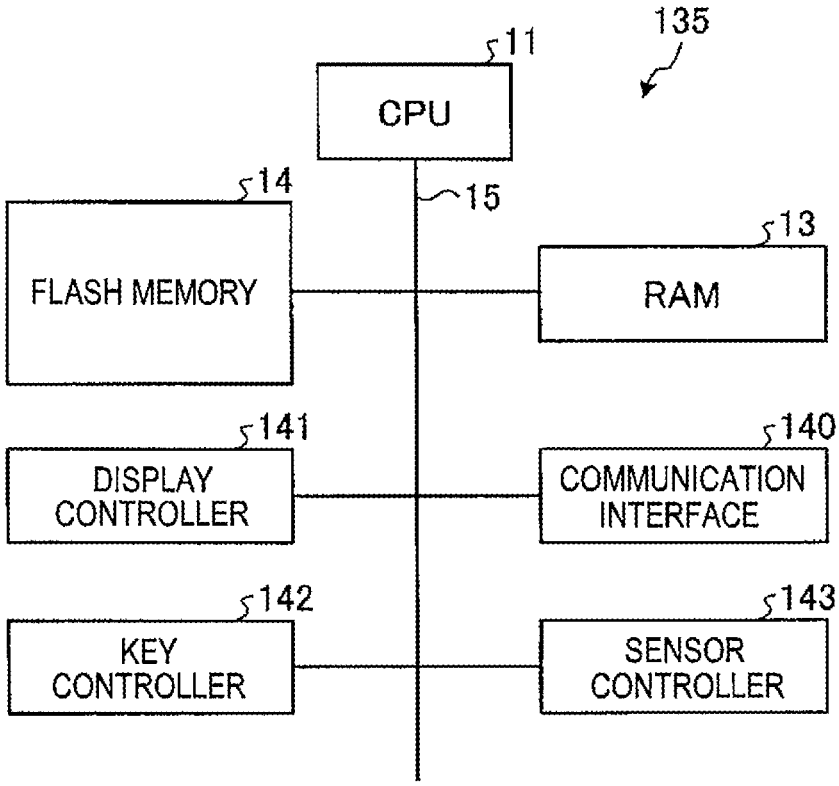
FIG. 5 is a block diagram showing the configuration of a print control unit.

FIG. 5 is a block diagram showing the configuration of the print control unit 135. As shown in FIG. 5, the print control unit 135 includes a CPU (central processing unit) 11 to perform various kinds of arithmetic processing to centrally control the respective components. A RAM 13 and a flash memory 14, i.e., a non-volatile memory capable of keeping stored contents despite interruption of electric power, are connected to the CPU 11 through a system bus 15.

The flash memory 14 stores operation programs and a variety of setting information of the printer 101. The CPU 11 deploys the operation programs stored in the flash memory 14 to the working area of the RAM 13, and executes the operation programs to control each component. The operation programs stored in the flash memory 14 includes, e.g., a program used to perform the control processing of the rotation speed of the platen roller 117 or the back-feed control processing of the backing sheet-attached label or the liner-less label. In addition, the flash memory 14 stores a rotation speed table and a back-feed length table respectively used in the control processing of the rotation speed of the platen roller 117 and in the back-feed control processing of the backing sheet-attached label or the liner-less label.

In this embodiment, the rotation speed table refers to a table in which the rotation speeds of the platen roller 117 are associated with the standard mode and the liner-less mode when printing the backing sheet-attached label or the liner-less label with the thermal head 112 in the respective modes. The rotation speed of the platen roller 117 associated with the liner-less mode is slower than that associated with the standard mode.

The back-feed length table refers to a table in which the lengths of the backing sheet-attached label or the liner-less label back-fed to the paper roll PR (hereinafter referred to as "back-feed length") are respectively associated with the standard mode and the liner-less mode. The back-feed length (e.g., 5 mm) associated with the liner-less mode is shorter than the back-feed length (e.g., 10 mm) associated with the standard mode.

The RAM 13 temporarily stores various kinds of variable information. A partial area of the RAM 13 is used as a print buffer to which the print data (image data) to be printed on the backing sheet-attached label or the liner-less label are deployed. The print data refers to the print object data received from a host computer (not shown). The print data may be stored in the flash memory 14. The host computer includes, e.g., a personal computer, a cellular phone or a handheld terminal and executes various kinds of arithmetic processing in response to a user's operational input.

A communication interface 140, a display controller 141, a key controller 142 and a sensor controller 143 are connected to the CPU 11 through the system bus 15. Under the control of the CPU 11, the display controller 141 controls the display (e.g., a remaining battery level, radio wave reception conditions or error messages) of the liquid crystal display 155 of the operation part 150. Under the control of the CPU 11, the key controller 142 controls the key inputs received from the power switch 151, the paper feeding button 152 and the pause button 153 of the operation part 150. Under the control of the CPU 11, the sensor controller 143 controls the inputs received from various sensors such as the cover opening-closing sensor 50 and the like.

The communication interface 140 refers to an interface configured to perform communication with the external devices such as the host computer and the like. The communication interface 140 may include an infrared communication tool such as an IrDA, a USB (Universal Serial Bus), a wireless LAN (Local Area Network), a RS-232C and Bluetooth (registered trademark). The communication interface 140 may communicate with a communication interface provided in the host computer.

The portable printer 101 further includes a power control circuit 200 arranged within the housing 102. Responsive to the on/off operation of the power switch 151 of the operation part 150, the power control circuit 200 performs software-control of the supply and cutoff of the electric power supplied from the external commercial power socket through the AC adapter 400 or the electric power supplied from the rechargeable battery 270 to the respective parts of the print mechanism 300. The term "software-control" refers to controlling the supply and cutoff of the electric power based on the control signals of the portable printer 101.

The power control circuit 200 includes a DC power input part 210, a voltage converting unit 220, a power monitoring unit 230, a power control unit 240, a power cutoff unit 250, a power source switching unit 260 and a system power supply circuit 280 as a power supply unit.

The voltage converting unit 220 converts the voltage of the DC power from the DC power input unit 210 in a certain voltage range (e.g., 10V to 25V) to a voltage appropriate for recharging the rechargeable battery 270 (e.g., a voltage of 8.4V or 16.8V, which varies depending on the specification of the rechargeable battery 270). In one embodiment, the rechargeable battery 270 is a lithium-ion battery. The rechargeable battery 270 performs its recharging operation in a CC/CV recharging method, namely in a constant current and constant voltage recharging method, by dropping the DC voltage supplied from outside.

When the recharging operation is performed, the voltage converting unit 220 may set a long-lifespan mode for prolonging the battery lifespan by varying the recharging voltage and current or by adjusting the recharge threshold value. The power monitoring unit 230 monitors the voltage of the DC power from the DC power input unit 210. The power cutoff unit 250 cuts off the DC power from the DC power input unit 210, if the voltage of the DC power detected by the power monitoring unit 230 falls outside a predetermined range (e.g., a range of 10V to 25V). The power source switching unit 260 switches the power supplied to the system power supply circuit 280, to the power supplied from the DC power input unit 210 or the power supplied from the rechargeable battery 270.

The power control unit 240 performs the control of the power cutoff unit 250 and the power source switching unit 260, as described below. If the power monitoring unit 230 detects that the DC power supplied from the DC power input unit 210 falls within a predetermined range (e.g., 10V to 25V), the power source switching unit 260 operates to allow the DC power from the DC power input unit 210 to flow into the voltage converting unit 220. The voltage converting unit 220 supplies the DC power for recharging (e.g., 8.4V) to the rechargeable battery 270. Similarly, the DC power from the DC power input unit 210 also flows into the system power supply circuit 280.

Upon receiving a print signal from the printer control unit 135 when the DC power is supplied from outside to the DC power input unit 210, the power control unit 240 operates the power source switching unit 260 to supply the power of the rechargeable battery 270 to the drive power for the print mechanism 300. Thereby, when a print instruction is received, the power supplied from the DC power input unit 210 to the print mechanism 300 is cut off. However, if the voltage of the DC power supplied from the DC power input unit 210 falls within a predetermined range, the power may be supplied from the DC power input unit 210 to the printer control unit 135.

Even when no print instruction is received, if the voltage of the DC power detected by the power monitoring unit 230 is lower than the voltage of the rechargeable battery 270, the power control unit 240 operates the power source switching unit 260 to supply the power from the rechargeable battery 270 to the system power supply circuit 280.

The system power supply circuit 280 feeds the electric power to the respective parts of the print mechanism 300 through the print control unit 135. The electric power within the allowable range of voltage is applied to the thermal head 112 of the print mechanism 300. In other words, when the printer 101 prints, the electric power cutoff unit 250 cuts off the electric power supplied from the DC power input unit 210, and the power source switching unit 260 allows the electric power from the rechargeable battery 270 to supply to the thermal head 112, so that a voltage greater than the allowable voltage is not supplied to the thermal head 112.

The system power supply circuit 280 supplies the electric power (of, e.g., 5V, 3.3V or 1.5V) required to drive the print control unit 135. In the system power supply circuit 280, the operation input voltages to be fed to the respective parts or units are set to ensure that the respective parts or units can properly operate within the range of the voltage of the external DC power and the rechargeable battery 270.

The system power supply circuit 280 performs the on/off control of the individual power systems that are driven by the DC power supplied from the rechargeable battery 270 and the DC power input unit 210. In other words, if the DC power input unit 210 is supplied with DC power, the system power supply circuit 280 allows DC power to flow from the DC power input unit 210 to the printer control unit 135. In contrast, if the DC power input unit 210 is not supplied with DC power, the system power supply circuit 280 allows DC power to flow from the rechargeable battery 270 to the printer control unit 135.

If the power control unit 240 allows DC power to flow from the rechargeable battery 270 to the printer control unit 135, the system power supply circuit 280 supplies the DC power to the print mechanism 300 via the printer control unit 135.

In addition to performing the control of the print mechanism 300, the print control unit 135 acquires information delivered from the voltage converting unit 220 and the system power supply circuit 280 during the power supplying period and transmits a charge startup instruction to the power control unit 240 if the voltage converting unit 220 and the system power supply circuit 280 are kept in a chargeable condition.

Depending on the circumstances, the print control unit 135 sets the portable printer 101 in different status modes. Examples of the status modes include a standby mode in which printing is immediately performed by the thermal head 112, a sleep mode in which the system stays in an energy-saving state to reduce power consumption, a print mode in which printing is performed by the thermal head 112, a charge mode in which the rechargeable battery 270 is charged, and a long-lifespan charge mode in which charging is performed at a low voltage without shortening the lifespan of the rechargeable battery 270.

Transition to the respective modes is controlled in the following manner.

When driven by the rechargeable battery 270, the portable printer 101 goes into the sleep mode after a specified time has lapsed from the standby mode. In the sleep mode, unnecessary power supplied to some functional parts is cut off and the communication interface 140 alone is ready to receive signals in a standby state. The sleep mode comes back to the normal standby mode if there is a need to operate the print mechanism 300 or if signal transmission or reception occurs in the communication interface 140 during the sleep mode.

While being supplied with external DC power, the portable printer 101 does not enter the sleep mode but stays in the normal standby mode. This allows the printer to readily start up the print mode. In the standby mode, the communication interface 140 is ready to receive signals in a standby state and the voltage converting unit 220 performs the charge control of the rechargeable battery 270.

In the portable printer 101 as described above, if the backing sheet-attached label or the liner-less label is discharged from the paper roll PR stored in the paper storage portion 105 and if the cover 107 is closed, the backing sheet-attached label or the liner-less label is interposed between the thermal head 112 and the platen roller 117 and also interposed between the head cover 116 and the paper pressing roller 118. If printing starts in this state under the control of the print control unit 135 and if the stepping motor 131 is driven by the control of the motor control unit 134, the backing sheet-attached label or the liner-less label is conveyed from the paper roll PR toward the paper outlet 110 via the thermal head 112. The thermal head 112 causes the heating elements 114 to generate heat under the control of the head control unit 133, thereby printing a certain content on the backing sheet-attached label or the liner-less label being conveyed.

Figure 6:
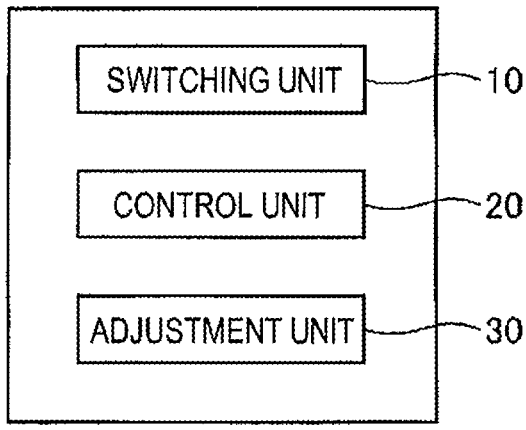
FIG. 6 is a block diagram of a portable printer according to one embodiment.

The functions executed and implemented by the CPU 11 according to the program stored in the flash memory 14 of the print control unit 135 will be described with reference to the block diagram illustrated in FIG. 6. FIG. 6 is a block diagram of the portable printer 101.

The program executed in the portable printer 101 of the present embodiment includes a module configuration containing parts or units as illustrated in FIG. 6 to switching unit 10, a control unit 20 and an adjustment unit 30). In the actual hardware, the CPU 11 reads the program from the flash memory 14 and executes the same, whereby the respective parts or units are loaded to the RAM 13 so that the respective parts or units (the switching unit 10, the control unit 20 and the adjustment unit 30) can be created in the RAM 13.

The switching unit 10 serves to switch the portable printer 101 to the standard mode or the liner-less mode in response to the switching operation inputted through the switching unit 157. Thus, the user can selectively switch the portable printer 101 to the standard mode or the liner-less mode depending on whether the paper roll PR loaded into the portable printer 101 is the roll of backing sheet-attached labels or the roll of liner-less labels.

In the present embodiment, while the portable printer 101 is switched to the standard mode or the liner-less mode in response to the switching operation inputted through the switching unit 157, the configuration of the portable printer 101 may not be limited thereto. For example, if a touch panel for detecting location of a touch is arranged in the liquid crystal display 155, an object enabling a switching operation to the standard mode or the liner-less mode may be displayed on the liquid crystal display 155. Also, the configuration of the switching unit 157 is not limited to a mechanical button but may be implemented by any type of switching configurations (a lever, electrical switch etc.) employed in the related art. Responsive to the switching operation of the object to the standard mode or the liner-less mode, the switching unit 10 may switch the portable printer 101 to the standard mode or the liner-less mode. Alternatively, the switching unit 10 may determine whether the paper roll PR stored in the paper storage portion 105 is the roll of backing sheet-attached labels or the roll of liner-less labels and, depending on the result of determination, may switch the portable printer 101 to the standard mode or the liner-less mode. As a further alternative, the switching unit 10 may switch the portable printer 101 to the standard mode or the liner-less mode according to a command transmitted from a host computer (not shown).

The control unit 20 controls the operation of the stepping motor 131 through the motor control unit 134 in response to the switching operation to the standard mode or the liner-less mode performed by the switching unit 10. For example, the control unit 20 performs control in such a fashion that the rotation speed of the platen roller 117 in the liner-less mode is lower than that in the standard mode. By doing so, the torque of the platen roller 117 when discharging the liner-less label from the paper roll PR may be set to be greater than the torque of the platen roller 117 when discharging the backing sheet-attached label from the paper roll PR. This may reduce the load applied to the stepping motor 131 when stripping the liner-less label from the paper roll PR to print on the liner-less label.

More specifically, if the portable printer 101 is switched to the standard mode by the switching unit 10, the control unit 20 determines the rotation speed associated with the standard mode in the rotation speed table stored in the flash memory 14 and sets the determined rotation speed to be the rotation speed of the platen roller 117 in the standard mode. Then, the control unit 20 determines a drive pulse period T according to the determined rotation speed and causes the motor control unit 134 to output a drive pulse signal having the determined period T to the stepping motor 131.

On the other hand, if the portable printer 101 is switched to the liner-less mode by the switching unit 10, the control unit 20 determines the rotation speed associated with the liner-less mode in the rotation speed table stored in the flash memory 14 and sets the determined rotation speed to be the rotation speed of the platen roller 117 in the liner-less mode. Then, the control unit 20 determines a drive pulse period T (longer than the drive pulse period T of the drive pulse signal outputted to the stepping motor 131 when the portable printer 101 is switched to the standard mode by the switching unit 10) according to the determined rotation speed and causes the motor control unit 134 to output a drive pulse signal having the determined period T to the stepping motor 131.

In addition, the control unit 20 is configured to ensure that the back-feed length of the liner-less label being back-fed to the thermal head 112 is shorter than the back-feed length of the backing sheet-attached label being back-fed to the thermal head 112.

More specifically, if the portable printer 101 is switched to the standard mode by the switching unit 10, the control unit 20 determines the back-feed length associated with the standard mode in the back-feed length table stored in the flash memory 14 and sets the determined back-feed length to be the back-feed length in the standard mode. According to the determined back-feed length, the control unit 20 determines the time period for which the drive pulse signal is to be outputted from the motor control unit 134 to the stepping motor 131 and causes the motor control unit 134 to output the drive pulse signal to the stepping motor 131 for the determined time period.

On the other hand, if the portable printer 101 is switched to the liner-less mode by the switching unit 10, the control unit 20 determines the back-feed length associated with the liner-less mode in the back-feed length table stored in the flash memory 14 and sets the determined back-feed length to be the back-feed length in the liner-less mode. According to the determined back-feed length, the control unit 20 determines the time period for which the drive pulse signal is to be outputted from the motor control unit 134 to the stepping motor 131 (shorter than the time period for which the drive pulse signal is to be outputted from the motor control unit 134 to the stepping motor 131 when the portable printer 101 is switched to the standard mode by the switching unit 10) and causes the motor control unit 134 to output the drive pulse signal to the stepping motor 131 for the determined time period.

The rotation speed of the platen roller 117 when back-feeding the liner-less label to the thermal head 112 in the liner-less mode is set equal to the rotation speed of the platen roller 117 when back-feeding the backing sheet-attached label to the thermal head 112 in the standard mode. That is, the drive pulse period T of the drive pulse signal outputted to the stepping motor 131 when back-feeding the liner-less label to the thermal head 112 is set equal to the drive pulse period T of the drive pulse signal outputted to the stepping motor 131 when back-feeding the backing sheet-attached label to the thermal head 112.

In general, In the portable printer 101, after cutting the backing sheet-attached label or the liner-less label printed, the backing sheet-attached label or the liner-less label positioned at the paper outlet 110 may be back-fed to the thermal head 112 so that the subsequent printing on the backing sheet-attached label or the liner-less label can be performed without leaving a gap with respect to the previously printed portion. In the printer of related art, the back-feed distance of the liner-less label is set equal to the back-feed distance of the backing sheet-attached label. In this case, as the back-feed length is increased, the resilience of the liner-less label is reduced and thus tends to be bent. This means that a paper jam is highly likely to occur.

With the present embodiment, however, the liner-less label may be back-fed without causing that paper jam by the bending of the liner-less label. This makes it possible to print the liner-less label without leaving a gap between printed portions and also prevent the occurrence of a paper jam.

The adjustment unit 30 serves to ensure that the power required when the portable printer 101 is switched to the liner-less mode by the switching unit 10 to print the liner-less label by the thermal head 112 is greater than the power required when the portable printer 101 is switched to the standard mode by the switching unit 10 to print the backing sheet-attached label by the thermal head 112. In general, silicon is applied on the liner-less label in an effort to increase the detachability from the adhesive surface. This often reduces the sensitivity when printing is performed by the thermal head 112. In the present embodiment, defective printing of the liner-less label is prevented by making the power required for printing the liner-less label greater than the power required for printing the backing sheet-attached label.

Figure 7:
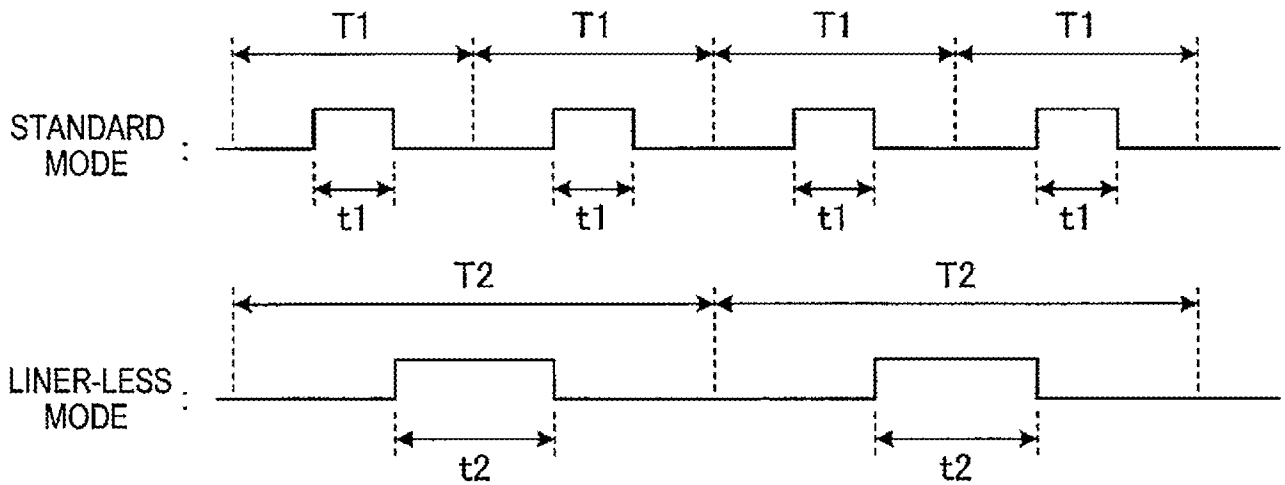
FIG. 7 is illustrates a strobe signal indicative of the heating time of a thermal head within a single-dot printing period.

FIG. 7 is a view illustrating a strobe signal indicative of the heating time of the thermal head within a single-dot printing period. As illustrated in FIG. 7, the adjustment unit 30 serves to ensure that the heating time t2 of the thermal head 112 within the single-dot printing period T2 (which is indicated by the strobe signal outputted to the head control unit 133) when the portable printer 101 is switched to the liner-less mode by the switching unit 10 is longer than the heating time t1 of the thermal head 112 within the single-dot printing period T1 (which is indicated by the strobe signal outputted to the head control unit 133) when the portable printer 101 is switched to the standard mode by the switching unit 10.

In addition, the rotation speed of the platen roller 117 during the back-feed operation may be set in the same way as the discharging operation. For example, during the back-feed operation, the control unit 20 may be configure to ensure that the rotation speed of the platen roller 117 in the liner-less mode is lower than that in the standard mode. By doing so, the torque of the platen roller 117 when back-feeding the liner-less label may be set to be greater than the torque of the platen roller 117 when back-feeding the backing sheet-attached label. Further, a rotation speed of the platen roller 117 for back-feed operation used in the control processing of the rotation speed of the platen roller 117 may also be stored in the flash memory 14.

Figure 8:
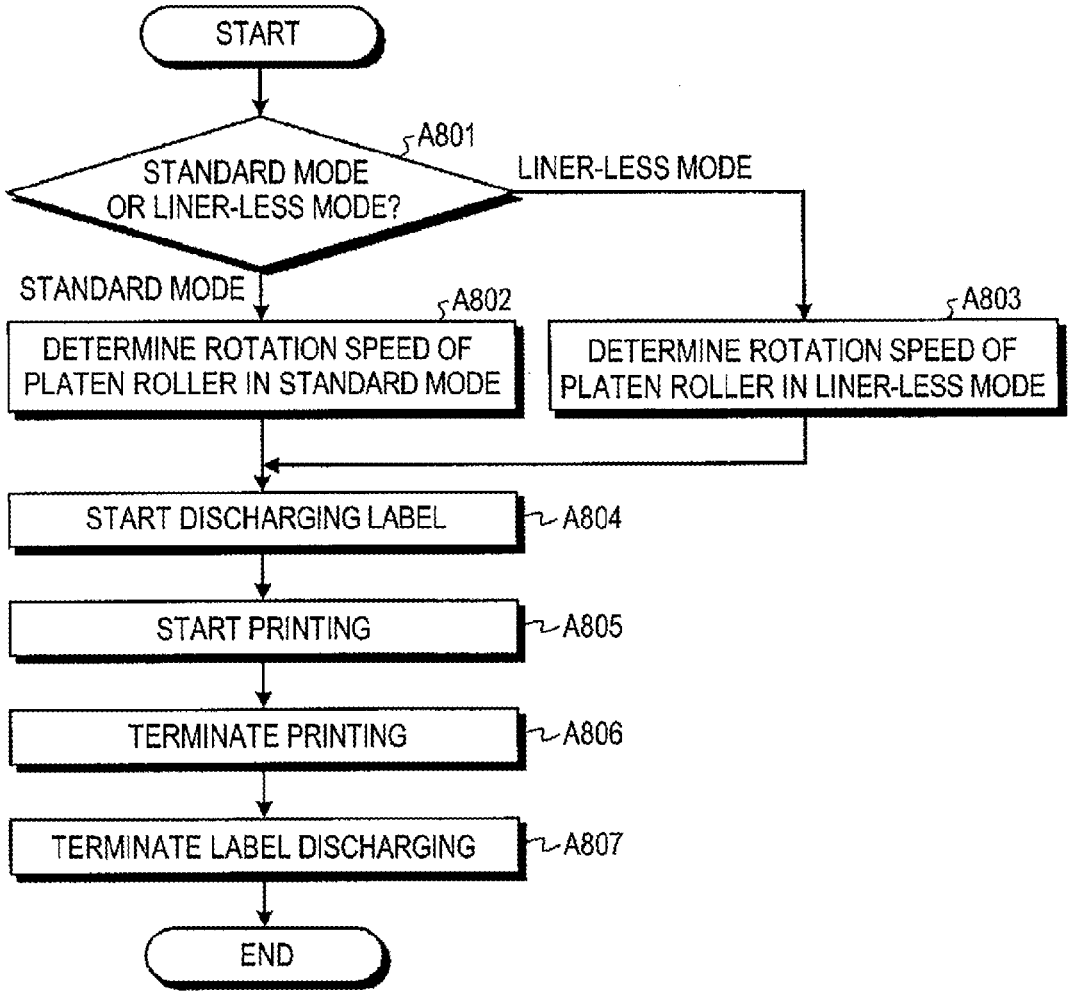
FIG. 8 is a flowchart illustrating a process to control the rotation speed of a platen roller.

In the following, the process of controlling the rotation speed of the platen roller 117 will be described with reference to FIG. 8, a flowchart illustrating a process to control the rotation speed of the platen roller.

Before the thermal head 112 starts printing, the control unit 20 determines whether the mode switched by the switching unit 10 is the standard mode or the liner-less mode (act A801).

If the mode switched by the switching unit 10 is the standard mode (i.e., in the standard mode in act A801), the control unit 20 determines the rotation speed associated with the standard mode in the rotation speed table stored in the flash memory 14 to be the rotation speed of the platen roller 117 in the standard mode (act A802). On the other hand, if the mode switched by the switching unit 10 is the liner-less mode (i.e., in the liner-less mode in act A801), the control unit 20 determines the rotation speed associated with the liner-less mode in the rotation speed table stored in the flash memory 14 to be the rotation speed of the platen roller 117 in the liner-less mode (act A803).

Then, the control unit 20 determines the drive pulse period T according to the rotation speed of the platen roller 117 as determined above, and causes the motor control unit 134 to output a drive pulse signal having the determined period T to the stepping motor 131. This allows the platen roller 117 to start discharging the backing sheet-attached label or the liner-less label from the paper roll PR (act A804).

If the discharge of the backing sheet-attached label or the liner-less label from the paper roll PR starts, the adjustment unit 30 outputs a strobe signal to the head control unit 133 so that the thermal head 112 can start printing (act A805).

If the print data stored in the RAM 13 are printed on the backing sheet-attached label or the liner-less label, the adjustment unit 30 stops outputting the strobe signal to the head control unit 133 so that the thermal head 112 can terminate printing (act A806).

Subsequently, if the thermal head 112 terminates printing, the control unit 20 stops outputting the drive pulse signal to the stepping motor 131 to thereby terminate the discharge of the backing sheet-attached label or the liner-less label from the paper roll PR (act A807).

Figure 9:
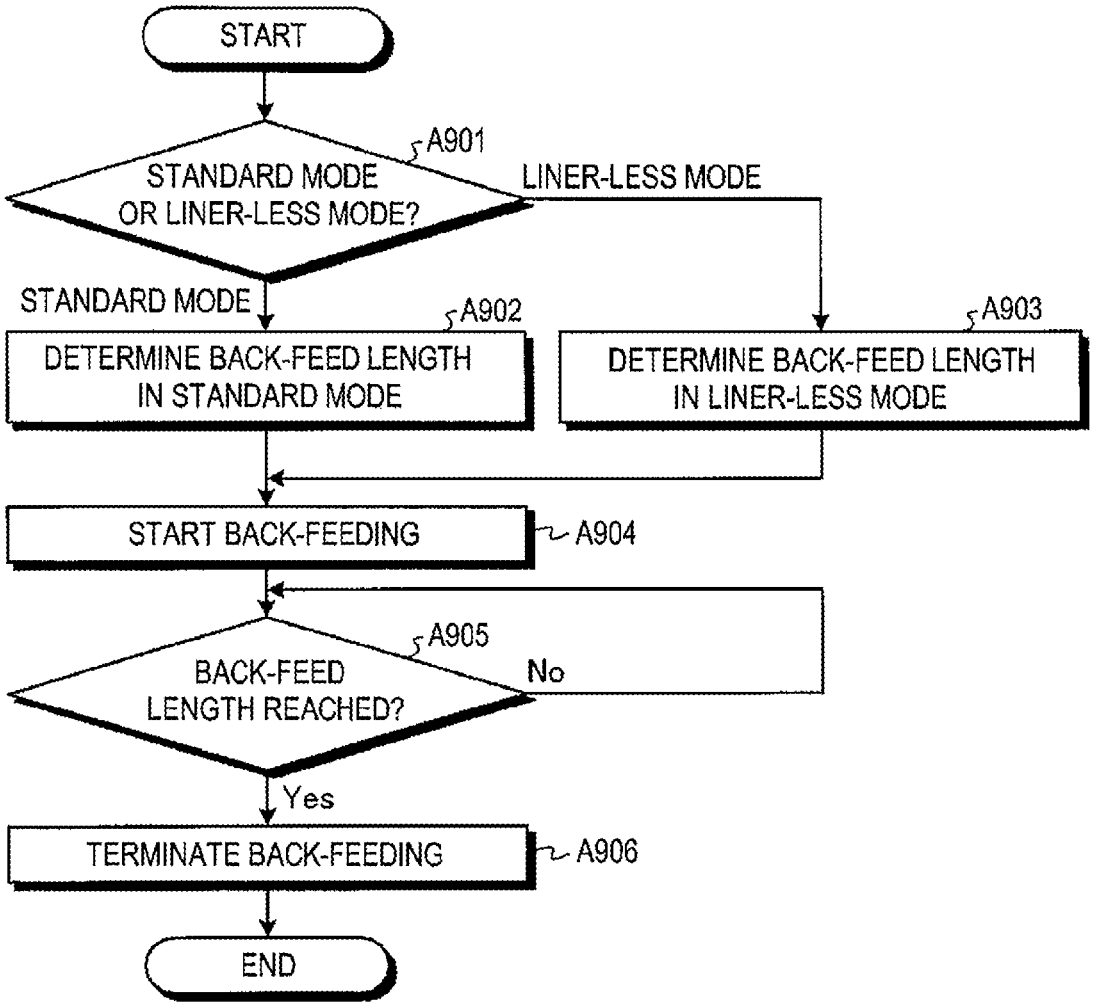
FIG. 9 is a flowchart illustrating a process to back-feed a backing sheet-attached label or a liner-less label.

Next, the process of controlling the back-feed of the backing sheet-attached label or the liner-less label will be described with reference to FIG. 9, a flowchart illustrating the processing flow to back-feed the backing sheet-attached label or the liner-less label.

If the thermal head 112 terminates printing, the control unit 20 determines whether the mode switched by the switching unit 10 is the standard mode or the liner-less mode (act A901).

If the mode switched by the switching unit 10 is the standard mode (i.e., in the standard mode in act A901), the control unit 20 determines the back-feed length associated with the standard mode in the back-feed length table stored in the flash memory 14 to be the back-feed length in the standard mode (act A902). On the other hand, if the mode switched by the switching unit 10 is the liner-less mode (i.e., in the liner-less mode in act A901), the control unit 20 determines the back-feed length associated with the liner-less mode in the back-feed length table stored in the flash memory 14 to be the back-feed length in the liner-less mode (act A903).

Then, the control unit 20 outputs a drive pulse signal to the stepping motor 131 to start back-feeding the backing sheet-attached label or the liner-less label positioned in the paper outlet 110 (act A904). While back-feeding the backing sheet-attached label or the liner-less label, the control unit 20 determines whether the back-fed length of the backing sheet-attached label or the liner-less label reaches the determined back-feed length (act A905).

If it is determined that the back-fed length of the backing sheet-attached label or the liner-less label reaches the determined back-feed length (i.e., in case of "Yes" in act A905), the control unit 20 stops outputting the drive pulse signal to the stepping motor 131 to thereby terminate the back-feeding of the backing sheet-attached label or the liner-less label (act A906).

The operation program executed in the portable printer 101 of the present embodiment may be provided by recording the same in a computer-readable recording medium such as a CD-ROM, a flexible disk (FD), a CD-R or a DVD (Digital Versatile Disk) in the form of an installable or executable file.

In addition, the operation program executed in the portable printer 101 of the present embodiment may be stored in a computer connected to a network such as the Internet so that the program can be downloaded from the computer via the network. Moreover, the operation program executed in the portable printer 101 of the present embodiment may be provided or distributed via a network such as the Internet.

In the portable printer 101 of the present embodiment described above, the operation of the stepping motor 131 is controlled according to the switching of the portable printer 101 to the standard mode or the liner-less mode. By doing so, the torque of the platen roller 117 when discharging the liner-less label from the paper roll PR can be made greater than the torque of the platen roller 117 when discharging the backing sheet-attached label from the paper roll PR. This may reduce the load applied to the stepping motor 131 when stripping the liner-less label from the paper roll PR to print the liner-less label. In particular, when the portable printer 101 of the present embodiment is operated with the electric power supplied from the rechargeable battery 270, the load of the stepping motor 131 may be reduced. This may reduce consumption of the rechargeable battery 270 and make the operation of the portable printer 101 last for a longer period of time. In addition, it is possible to prevent the liner-less label from being bent when back-feeding the liner-less label, consequently preventing occurrence of a paper jam. Moreover, it is possible to reduce the wasting of the liner-less label by increasing the print area thereof.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and a entity can be localized on one apparatus and/or distributed between two or more apparatuses.

The program for realizing the functions can be recorded in the apparatus, can be downloaded through a network to the apparatus and can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS(Operating System) or the like in the apparatus.

While certain embodiments have been described above, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer, comprising:

a motor;

a roller configured to be turned by the motor to discharge a backing sheet-attached label from a roll wound with the backing sheet-attached label, or a liner-less label from a roll wound with the liner-less label with an adhesive surface on one side of the liner-less label;

a print unit configured to perform printing on the backing sheet-attached label or the liner-less label discharged from the roll;

a switching unit configured to switch the printer to a standard mode in which the print unit performs printing on the backing sheet-attached label or a liner-less mode in which the print unit performs printing on the liner-less label;

a control unit configured to control the operation of the motor in response to the switching of the printer to the standard mode or the liner-less mode; and a paper outlet arranged at the downstream side of the print unit along the discharging direction of the backing sheet-attached label or the liner-less label to cut the backing sheet-attached label or the liner-less label upon completion of printing, wherein the roller is turned by the motor in the direction opposite to the direction in which the backing sheet-attached label or the liner-less label is discharged from the roll, to thereby back-feed the backing sheet-attached label or the liner-less label positioned in the paper outlet, and wherein the control unit is configured so that in the liner-less mode, the liner-less label is back-fed to the print unit a shorter length than the length that the backing sheet-attached label is back-fed to the print unit in the standard mode.

2. The printer of claim 1, wherein the control unit is configured so that in the liner-less mode, the liner-less label is printed by the print unit with a rotation speed of the roller lower than a rotation speed of the roller when the backing sheet-attached label is printed by the print unit in the standard mode.

3. The printer of claim 1, further comprising a paper outlet arranged at the downstream side of the print unit along the discharging direction of the backing sheet-attached label or the liner-less label to cut the backing sheet-attached label or the liner-less label upon completion of printing, and wherein the roller is turned by the motor in the direction opposite to the direction in which the backing sheet-attached label or the liner-less label is discharged from the roll, to thereby back-feed the backing sheet-attached label or the liner-less label that is positioned in the paper outlet, and wherein the control unit is configured so that in the liner-less mode, the liner-less label is back-fed with a rotation speed of the roller lower than a rotation speed of the roller when the backing sheet-attached label is back-fed in the standard mode.

4. The printer of claim 1, further comprising a battery configured to supply electric power to the motors, wherein the motor is driven by the electric power supplied from the battery.

5. The printer of claim 1, wherein the print unit comprises a print head configured to perform printing by heating the backing sheet-attached label or the liner-less label, and wherein the roller comprises a platen roller arranged to be opposed to the print head.

6. The printer of claim 1, further comprising an adjustment unit configured so that in the liner-less mode, the liner-less label is printed by the print unit with power greater than power required when the backing sheet-attached label is printed by the print unit in the standard mode.

7. The printer of claim 6, wherein the adjustment unit is configured so that in the liner-less mode, the liner-less label is printed by the print unit with a heating time of a thermal head within a single-dot printing period longer than a heating time of the thermal head within the single-dot printing period when the backing sheet-attached label is printed by the print unit in the standard mode.

8. A printing method for use in a printer including a motor, a roller configured to be turned by the motor to discharge a backing sheet-attached label from a roll wound with the backing sheet-attached label, or a liner-less label from a roll wound with the liner-less label with an adhesive surface on one side of the liner-less label, and a print unit configured to perform printing on the backing sheet-attached label or the liner-less label discharged from the roll, the printing method comprising:

causing a switching unit to switch the printer to a standard mode in which the print unit performs printing on the backing sheet-attached label or a liner-less mode in which the print unit performs printing on the liner-less label;

causing a control unit to control the operation of the motor in response to the switching of the printer to the standard mode or the liner-less mode; and causing the roller to be turned by the motor in the direction opposite to the direction in which the backing sheet-attached label or the liner-less label is discharged from the roll, to thereby back-feed the backing sheet-attached label or the liner-less label that is positioned in a paper outlet, wherein the control unit is configured so that in the liner-less mode, the liner-less label is back-fed to the print unit a shorter length than the length that the backing sheet-attached label is back-fed to the print unit in the standard mode.

9. The method of claim 8, wherein the control unit is configured so that in the liner-less mode, the liner-less label is printed by the print unit with a rotation speed of the roller lower than a rotation speed of the roller when the backing sheet-attached label is printed by the print unit in the standard mode.

10. The method of claim 8, further comprising causing the roller to be turned by the motor in the direction opposite to the direction in which the backing sheet-attached label or the liner-less label is discharged from the roll, to thereby back-feed the backing sheet-attached label or the liner-less label that is positioned in a paper outlet, wherein the control unit is configured so that in the liner-less mode, the liner-less label is back-fed with a rotation speed of the roller lower than a rotation speed of the roller when the backing sheet-attached label is back-fed in the standard mode.

11. The method of claim 8, further comprising driving the motor by electric power supplied from a battery.

12. The method of claim 8, wherein the print unit prints by heating the backing sheet-attached label or the liner-less label, and wherein the roller comprises a platen roller arranged to be opposed to a print head of the print unit.

13. The method of claim 8, wherein power required when the liner-less label is printed by the print unit in the liner-less mode is greater than power required when the backing sheet-attached label is printed by the print unit in the standard mode.

14. The method of claim 13, wherein a heating time of a thermal head within a single-dot printing period when the liner-less label is printed by the print unit in the liner-less mode is longer than a heating time of the thermal head within the single-dot printing period when the backing sheet-attached label is printed by the print unit in the standard mode.

* * * * *